US005897012A

United States Patent [19]

Sortwell

[11] Patent Number: 5,897,012

[45] **Date of Patent: *Apr. 27, 1999**

[54] COLLAPSIBLE INTERMEDIATE BULK CONTAINER

[75] Inventor: Edwin T. Sortwell, Wheaton, Ill.

[73] Assignee: Sortwell & Co., St. Simons Island, Ga.

[ * ] Notice: This patent issued on a continued prosecution application filed under 37 CFR 1.53(d), and is subject to the twenty year patent term provisions of 35 U.S.C. 154(a)(2).

[21] Appl. No.: 08/833,284

[22] Filed: Apr. 4, 1997

[51] Int. Cl.[6] ..... B65D 6/26

[52] U.S. Cl. ..... 220/4.28; 220/6; 220/9.4; 220/666; 220/23.91; 220/495.06; 206/600

[58] Field of Search ..... 220/1.5, 403, 404, 220/401, 400, 6, 7, 666, 668, 9.1, 9.2, 9.3, 9.4, 23.91, 4.28, 495.06, 495.03

[56] References Cited

U.S. PATENT DOCUMENTS

| | | | |
|---|---|---|---|
| 537,401 | 4/1895 | Avery . | |
| 858,488 | 7/1907 | Tynes | 220/9.2 |
| 875,266 | 12/1907 | Howe et al. | 220/9.2 |
| 2,432,025 | 12/1947 | Lorenz | 220/666 |

(List continued on next page.)

FOREIGN PATENT DOCUMENTS

| | | | |
|---|---|---|---|
| 537 401 | 11/1931 | Germany | 220/9.2 |
| 1 293 750 | 10/1972 | United Kingdom | 220/401 |

OTHER PUBLICATIONS

Brochure entitled "Ecotainer MX" from Schutz Container Systems, Inc. (2 pages), Jan., 1993.

Product Literature entitled "Rhino Bulk Bags & Liners" from Custom Packaging Systems, Inc., Manistee, Michigan (27 pages), date of publication unknown.

Brochure entitled "Van Leer Concertainer®—The Reusable Cost–Effective Collapsible Intermediate Bulk Container (CIBC)" from Van Leer Packaging Worldwide, Chicago, IL (4 pages), date of publication unknown.

Brochure entitled "Flexitote—Bag–in–Bag Steel Frame Collapsible Container" from Hoover Materials Handling Group, Inc., Alpharetta, Georgia (4 pages), date of publication unknown.

Brochure entitled "Flutainer®—The New Solution for the Storage and Transport of Liquids," from Empac Verpackungs—GmbH and B.A.G. Corp., Dallas, Texas (4 pages), date of publication unknown.

Brochure entitled "Stack Pack—The Bulk Bag That Stays Square and Stacks . . . Like a Box," from Bulk–Pack, Inc., Denison, Texas (2 pages), date of publication unknown.

*Primary Examiner*—Stephen Castellano

*Attorney, Agent, or Firm*—Marshall, O'Toole, Gerstein, Murray & Borun

[57] ABSTRACT

A collapsible intermediate bulk container for liquid or freely flowable solid materials includes either a fabric outer/film liner bag or a bag of fabric reinforced elastomer. The bag is supported by a collapsible rigid frame which gradually collapses as the bag is emptied. The collapsible rigid frame includes a pallet-base portion that has an upper surface that is sloped to a center drainage point to facilitate complete emptying. The pallet-base portion contains a valve arrangement fixed to either the fabric outer bag (in the film-lined configuration) or to the reinforced fabric bag, at the center drainage point. The collapsed frame provides a compact return package. Either bag configuration may be reused or replaced in whole or in part.

19 Claims, 8 Drawing Sheets

U.S. PATENT DOCUMENTS

| | | | |
|---|---|---|---|
| 2,507,939 | 5/1950 | Smith | 220/666 |
| 2,623,565 | 12/1952 | Unthank | 220/666 |
| 2,720,998 | 10/1955 | Potter | 220/6 |
| 2,725,087 | 11/1955 | Potter | 220/666 |
| 2,916,058 | 12/1959 | Unthank | 220/666 |
| 2,931,409 | 4/1960 | Unthank | 220/666 |
| 3,107,712 | 10/1963 | Bergeretto | 220/9.2 |
| 3,295,738 | 1/1967 | Keuchenius et al. | 229/6 |
| 4,036,361 | 7/1977 | Jacobson et al. . | |
| 4,596,040 | 6/1986 | LaFleur et al. | 383/7 |
| 4,640,328 | 2/1987 | Arney | 220/9.4 |
| 4,715,508 | 12/1987 | Schurch | 220/7 |
| 4,781,472 | 11/1988 | LaFleur et al. | 220/403 |
| 4,817,824 | 4/1989 | LaFleur et al. | 220/105 |
| 5,002,194 | 3/1991 | Nichols | 220/1.5 |
| 5,056,667 | 10/1991 | Coogan | 206/600 |
| 5,269,414 | 12/1993 | D'Hollander | 206/600 |
| 5,437,384 | 8/1995 | Farrell | 220/9.2 |
| 5,622,277 | 4/1997 | Van Giezen et al. | 220/9.4 |
| 5,653,354 | 8/1997 | Olson | 220/9.1 |
| 5,746,343 | 5/1998 | Waltke et al. | 220/9.2 |

FIG. 15
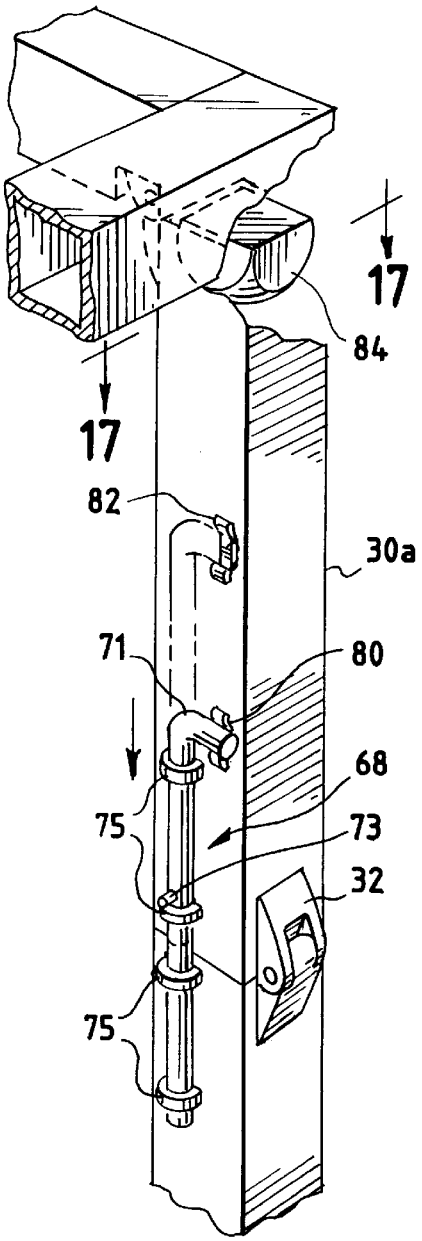
FIG. 16
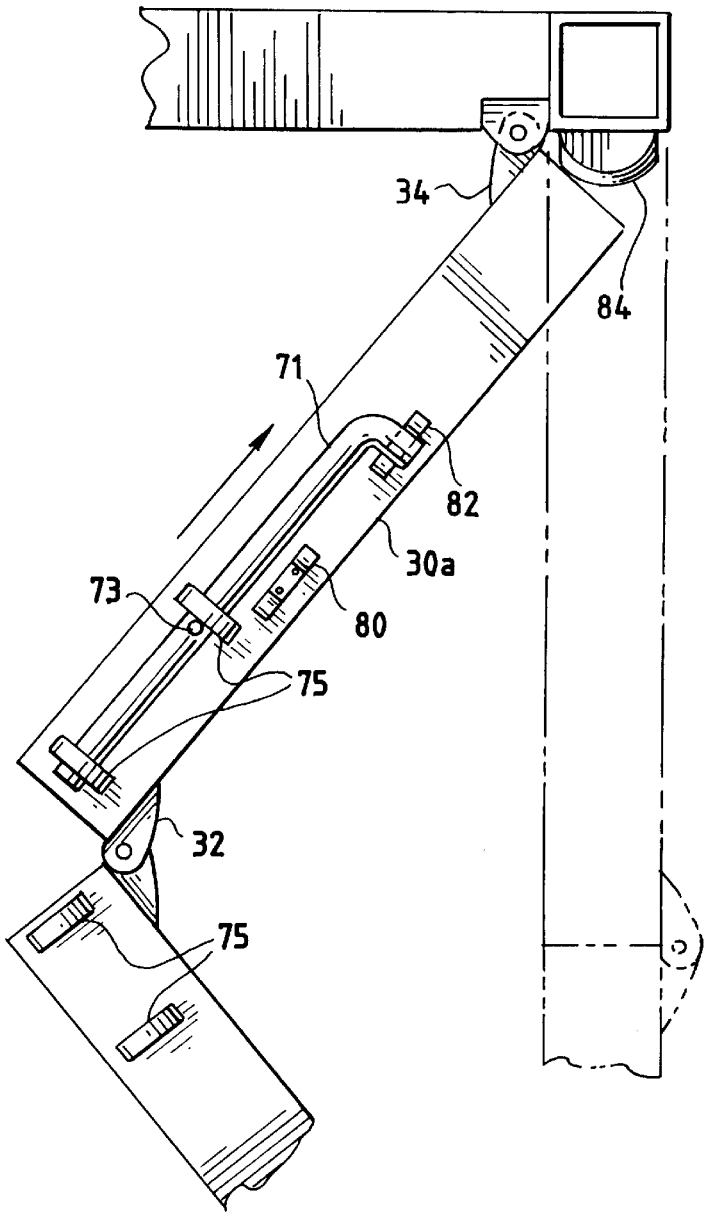
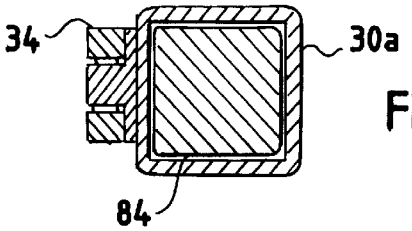
FIG. 17

COLLAPSIBLE INTERMEDIATE BULK CONTAINER

BACKGROUND OF THE INVENTION

1. Field of the Invention

The invention relates generally to containers for transporting or storing liquids or freely flowable solids. Specifically, the invention relates to collapsible, reusable, and stackable intermediate bulk containers.

2. Description of Related Technology

Intermediate bulk containers are used for shipping and storing liquids such as chemicals, beverages, or food products, or freely flowable solids such as grains, livestock feeds, chemicals in powder form, and minerals in powder form. Recent designs for rigid intermediate bulk containers have typically been rectangular in shape. It is desirable to be able to move bulk containers using a fork lift and to stack them to maximize the use of storage and shipping space. To perform this function, many types of bulk containers include pallet-type bases that are compatible with standard fork lifts. Rigid bulk containers present a problem of wasted space in storing or shipping the containers when empty.

The problem of wasted space has been addressed by the development of flexible bag type bulk containers that are well known in the art. For example, LaFleur, et al., U.S. Pat. No. 4,596,040 discloses a generally rectangularly shaped large bulk bag formed from a tubular blank of woven fabric. Such flexible bag containers are used for dry material shipping and storage and are desirable for use in storing and shipping liquid or freely flowable solid materials. They cannot, however, be used for shipment or storage of liquid or freely flowable solid materials unless structural support is provided. Flexible bag containers can also be sterilized and used in conjunction with "tamper evident" seals on inlet and outlet fittings, for example, for use when holding food products.

In order to stack flexible bag containers and ensure the stability of a flexible bag container when full and in shipment, it is often desirable to reinforce the container by attaching it to a rigid frame. This is particularly important for storage and shipment of liquid materials. It is also desirable for the rigid frame to be capable of collapsing for transport or storage once the container is empty. Collapsible rigid frames for this purpose are disclosed in LaFleur et al., U.S. Pat. No. 4,817,824, D'Hollander, U.S. Pat. No. 5,269,414, and Potter, U.S. Pat. No. 2,720,998. Similarly, collapsible rigid frames for holding flexible bag containers are available commercially under the trademark CONCERTAINER®, from Van Leer Containers, Inc., 4300 West 130th Street, Chicago, Ill. 60658, under the trademark FLEXITOTE™, from Hoover Materials Handling Group, Inc., 2001 Westside Parkway, Suite 155, Alpharetta, Ga. 30201, and under the trademark FLUTAINER®, from B.A.G. Corp., 11510 Data Drive, Dallas, Tex. 75218.

The aforementioned collapsible rigid frames, when used in conjunction with a flexible bag container, are not configured to be collapsed until the flexible bag is empty. This is a disadvantage because if the rigid frame could collapse gradually, the weight of components of the rigid frame disposed above the flexible bag could serve to provide a downward force on the flexible bag, thereby assisting in the emptying of the contents of the flexible bag.

In addition, the collapsible rigid frames require manual separation of components of the frame for collapsing, usually by two people, and this presents the possibility of losing components of the frame. The available collapsible rigid frames must also be set up before the container held by thereby can be filled.

SUMMARY OF THE INVENTION

It is an object of the invention to overcome one or more of the problems described above.

In accordance with one aspect of the invention, a collapsible bulk container comprising a frame and a flexible bag for holding liquids or freely flowable solids, disposed within, and secured to the frame, is provided. The frame is adapted to gradually collapse as the flexible bag is emptied.

Other objects and advantages of the invention will be apparent to those skilled in the art from a review of the following detailed description taken in conjunction with the drawings and the appended claims.

BRIEF DESCRIPTION OF THE DRAWINGS

FIG. 15 is an enlarged fragmentary perspective view of an articulated frame member and an alternative locking mechanism, in accordance with the invention, in a locked position;

FIG. 16 is an enlarged fragmentary isometric view of the articulated frame member and the alternative locking mechanism of FIG. 15, in an unlocked position; and FIG. 17 is a cross-sectional view of the articulated frame member of FIG. 15, taken along lines 17—17 of FIG. 15.

DETAILED DESCRIPTION OF THE INVENTION

Figure 1:
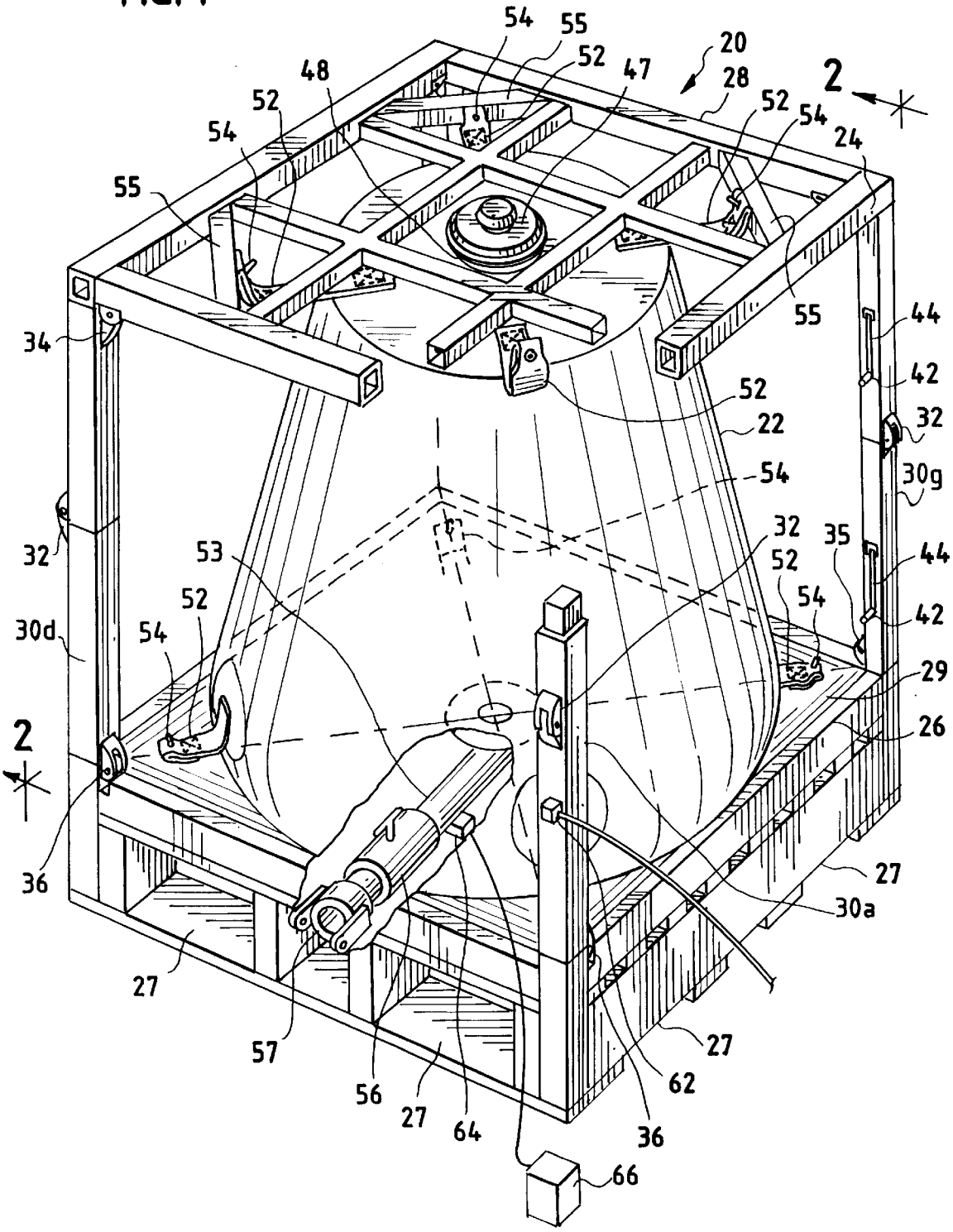
FIG. 1 is a partially fragmented perspective view of a container in accordance with the invention, in a fully filled configuration.

With reference to FIG. 1, the invention provides a collapsible bulk container, generally designated as 20, comprising a flexible bag 22, adapted to hold liquids or freely flowable solids. The flexible bag 22 is secured to a frame 24, that is capable of being gradually collapsed as the flexible bag 22 empties, or gradually erected by the flexible bag 22 during filling. Preferably, the flexible bag has a substantially tapered vertical cross-sectional shape.

The frame 24 includes a pallet-base portion 26 that is formed of wood, plastic, or metal into a standard four-way entry pallet configuration, having slots 27 adapted to receive fork lift tines (not shown). The upper surface 29 of the pallet-base portion 26 is concave to ensure proper draining of the flexible bag 22. The frame 24 also includes an upper frame portion 28 and four articulated frame members 30*a*, 30*b*, 30*c*, and 30*d*. The upper frame portion 28 is attached to the pallet-base portion 26 by means of the four articulated frame members 30*a–d*. Each articulated frame member 30*a–d* includes a midspan hinge 32, an upper hinge 34 (connecting each articulated frame member 30*a–d* to the upper frame portion 28), and a lower hinge 36 (connecting each articulated frame member 30*a–d* to the pallet-base portion 26).

Figure 11:
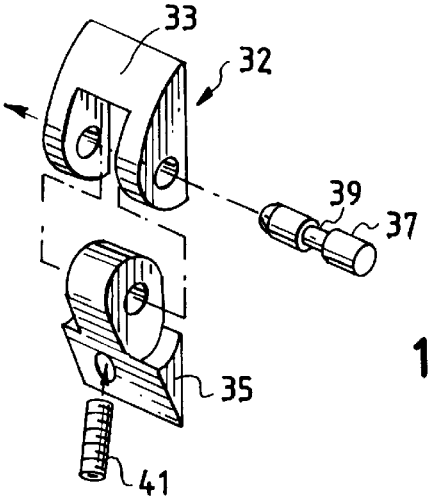
FIG. 11 is a exploded perspective view of a hinge used as part of the frame portion of the container of FIG. 1.

As seen in FIG. 11, each midspan hinge 32 includes a first hinge knuckle 33 and a second hinge knuckle 35 that is pivotally attached to the first hinge knuckle 33 by means of a hinge pin 37. The hinge pin 37 includes an annular slot 39 and a locking screw 41 is threaded into the second hinge knuckle 35 and extends into the annular slot 39 to retain the hinge pin 37 within the midspan hinge 32. Although not shown in detail, each upper hinge 34 and lower hinge 36 may be of essentially identical construction to that of each midspan hinge 32. The hinges 32, 34, and 36 may also be of conventional strap-hinge construction, and may be attached to the frame 24 by any suitable means (not shown), for example, such as by welds, rivets, or screws.

Figure 2:
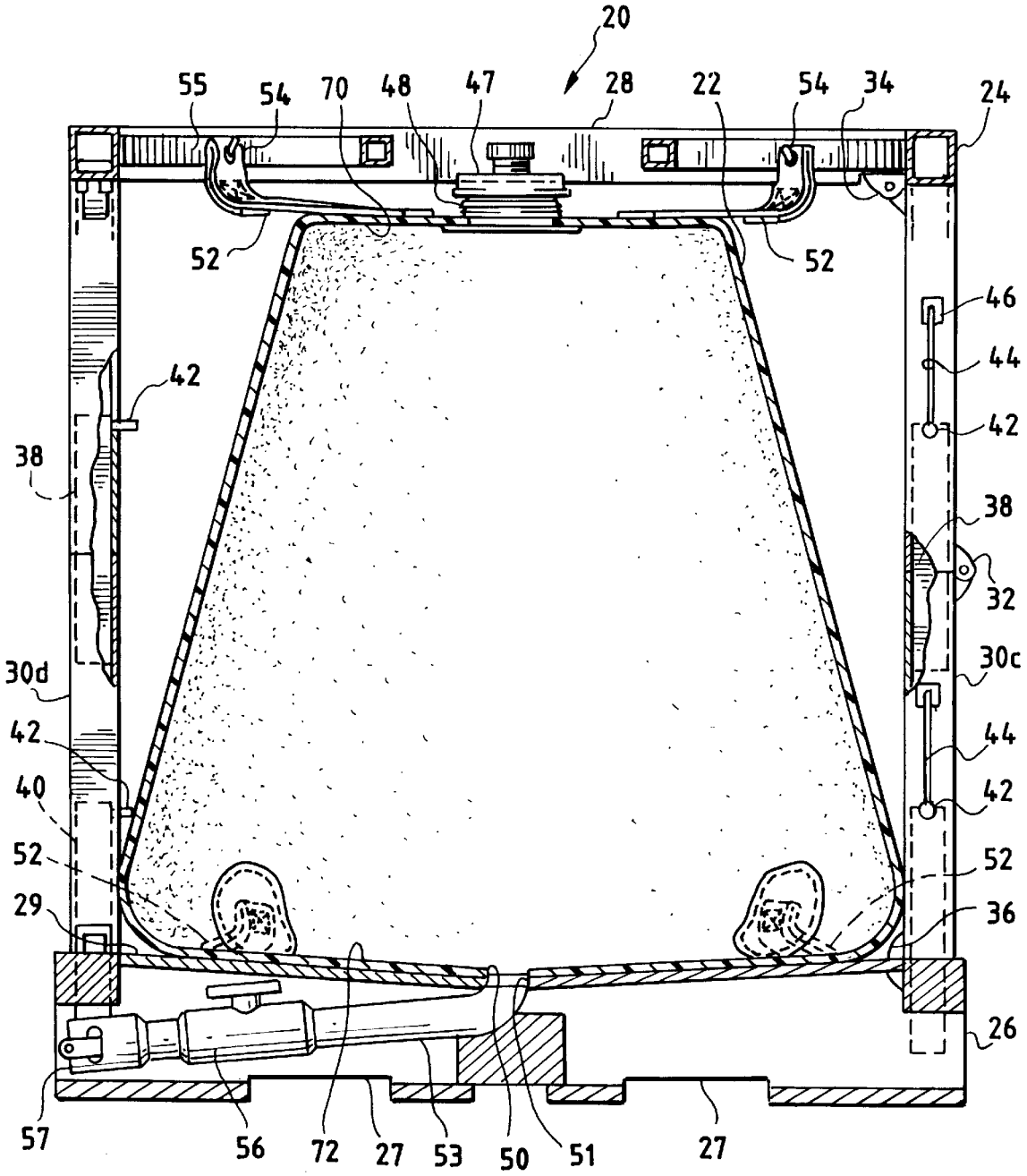
FIG. 2 is a cross-sectional view of the container of FIG. 1, taken along lines 2—2 of FIG. 1.
Figure 3:
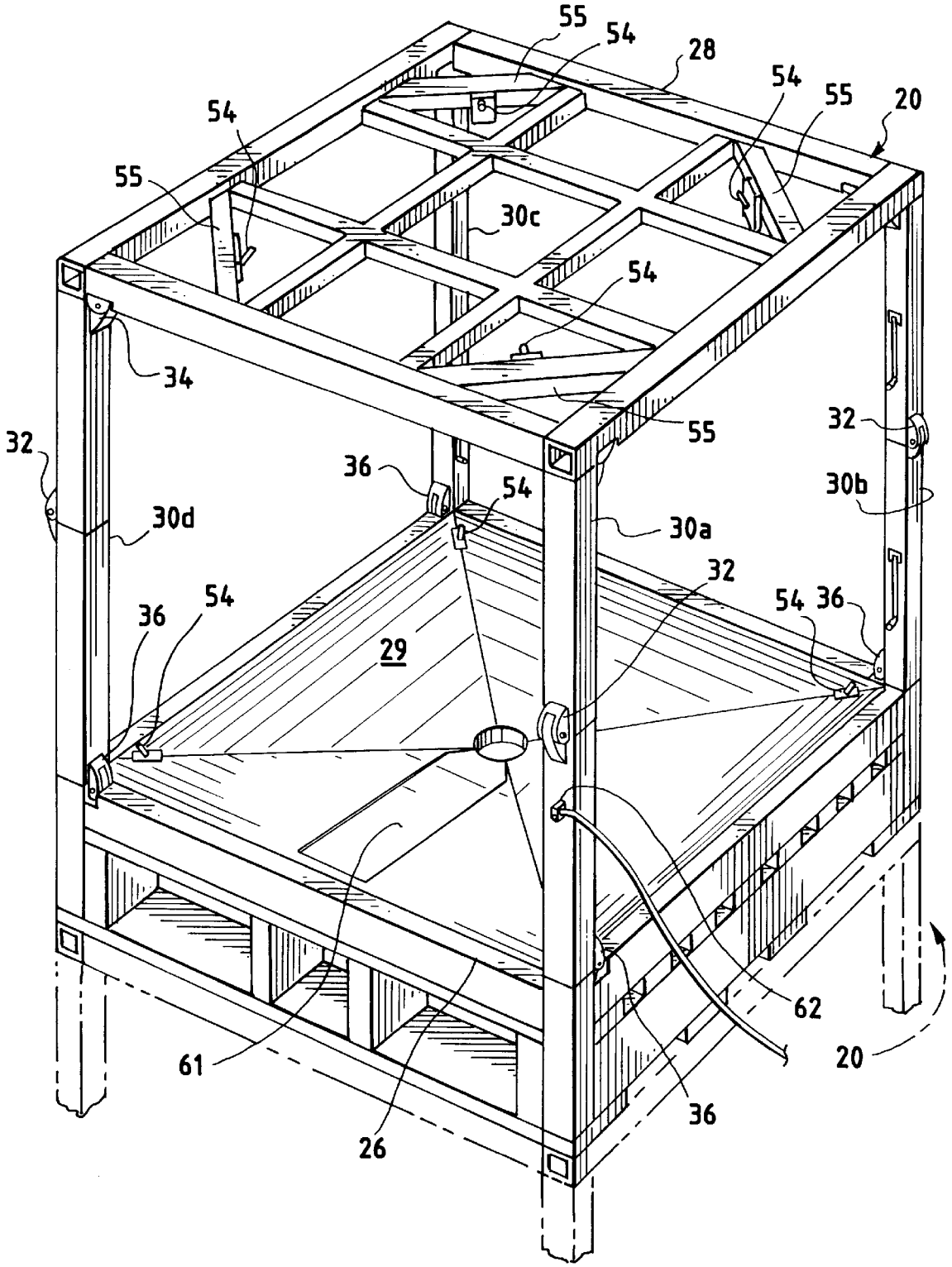
FIG. 3 is a perspective view of a frame portion of the container of FIG. 1, in a stacked configuration.

A midspan locking pin 38 is disposed within each articulated frame member 30*a–d*, in the vicinity of the midspan hinge 32, and is movable between a locked position, as shown in FIGS. 1–3, and an unlocked position, as shown in FIGS. 6–10. When each midspan locking pin 38 is in the locked position, the associated midspan hinge 32 is held in a straight position, as shown in FIGS. 1–3. When each midspan locking pin 38 is in the unlocked position, the associated midspan hinge 32 is free to bend, as shown in FIGS. 7–10.

Similarly, a lower locking pin 40 is disposed within each articulated frame member 30*a–d*, in the vicinity of the lower hinge 36, and is movable between a locked position, as shown in FIGS. 1–3, and an unlocked position, as shown in FIGS. 6–10. When each lower locking pin 40 is in the locked position, the associated lower hinge 36 is held in a straight position, as shown in FIGS. 1–3. When each lower locking pin 40 is in the unlocked position, the associated lower hinge 36 is free to bend, as shown in FIGS. 7–10.

The midspan locking pins 38 and the lower locking pins 40 are of essentially identical construction and each includes a transverse stud 42 that protrudes through a slot 44 in the associated articulated frame member 30*a–d*. A slotted rubber grommet 46, disposed at the top of each slot 44, holds the stud 42 in the upper position, thereby retaining the associated locking pin 38 or 40 in the unlocked position.

It is not necessary to provide any locking means for the upper hinges 34, as no movement of the upper hinges 34 is possible when the midspan hinges 32 are held in the straight position by the midspan locking pins 38. In fact, the lower locking pins 40 are not essential, as no movement of the lower hinges 36 is possible when the midspan hinges 32 are held in the straight position by the midspan locking pins 38. However, the lower locking pins 40 are included to provide additional rigidity (i.e. to minimize "play") in the frame 24, and to add an extra margin of safety, for example, when multiple containers are stacked one upon the other, as shown in FIG. 3.

The flexible bag 22 may include either an integral, fabric-reinforced layer coated and/or impregnated with sealant (such as an elastomer sealant), or a separate fabric bag lined with one or more waterproof film layers. As best seen in FIG. 2, the flexible bag 22 also includes a top fitment 48, that may be used for either filling the flexible bag 22 or emptying the flexible bag 22, and a bottom fitment 50, that also may be used for either filling or emptying the flexible bag 22. The top fitment 48 typically has a diameter of about six inches (about 15.24 cm) and may be large enough to accommodate an agitator (not shown), that may be mounted on the frame 24, for product mixing before discharge. A cap 47 is threaded onto the top fitment 48 and includes a standard fitting having a diameter of about two inches (about 5.08 cm). The bottom fitment 50 may be connected, for example, to a two inch (5.08 cm) diameter center discharge port 51 that is in turn connected to a two inch (5.08 cm) diameter discharge pipe 53 having a conventional two inch (5.08 cm) diameter discharge valve 56 therein. The discharge valve 56 may lead to a quick-connect discharge fitting 57.

Figure 12:
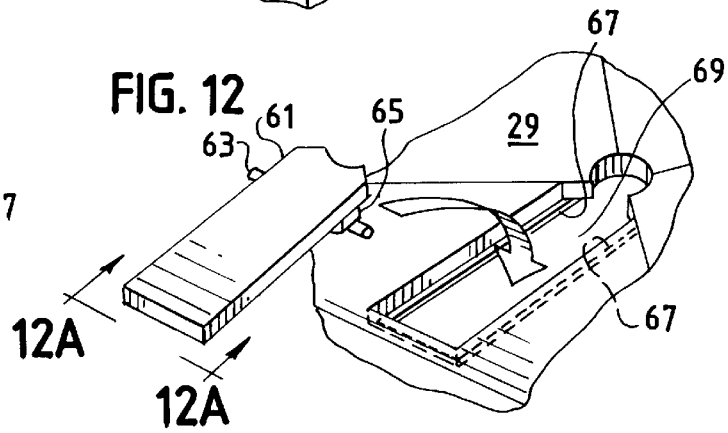
FIG. 12 is an enlarged exploded fragmentary perspective view of an access panel forming part of the container of FIG. 1.
Figure 12A:
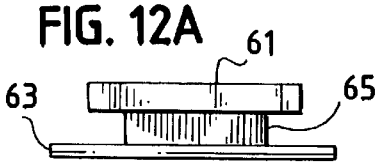
FIG. 12A is an enlarged end view of the access panel of FIG. 12, taken along lines 12A—12A of FIG. 12.

The upper surface 29 of the pallet-base portion 26 includes an access panel 61 (FIGS. 12 and 12A) that can be moved when it is necessary to install or remove the discharge pipe 53, the discharge valve 56, or the discharge fitting 57. A transverse pin 63 is attached to the access panel 61 by means of a spacer 65. The access panel 61 can be installed into the upper surface 29 of the pallet-base portion 26. The spacer 65 has a thickness greater than the thickness of a lip 67 that defines an opening 69 on the upper surface of the pallet-base portion 26. Therefore, the access panel 61 fits snugly within the opening 69, and the access panel 61 can be tilted and moved to the outer edge of the pallet-base portion 26, to provide access to the discharge pipe 53, the discharge valve 56, or the discharge fitting 57. However, the access panel 61 is preferably installed so that it cannot be completely separated from the pallet-base portion 26.

The flexible bag 22 can have a capacity in a range of from about 150 to about 280 U.S. gallons (about 570 to about 1,060 liters), preferably from about 200 to about 250 U.S. gallons (about 750 to about 940 liters). In the case of the film-lined fabric bag, the film lining is mechanically sealed to the top and bottom fitments 48, 50, and the top fitment 48 and the bottom fitment 50 are each in turn fastened to the outer fabric bag to ensure that any stress is taken up by the outer fabric bag and not the film liner.

Figure 13:
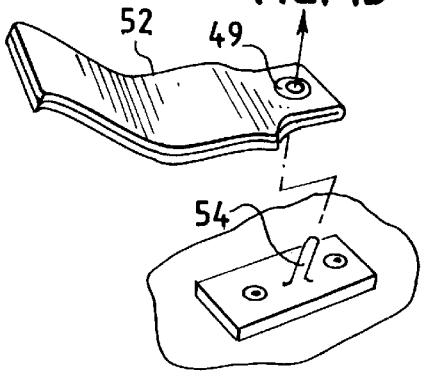
FIG. 13 is an enlarged exploded perspective view of a grommetted strap and a cleat used in the container of FIG. 1.
Figure 14:
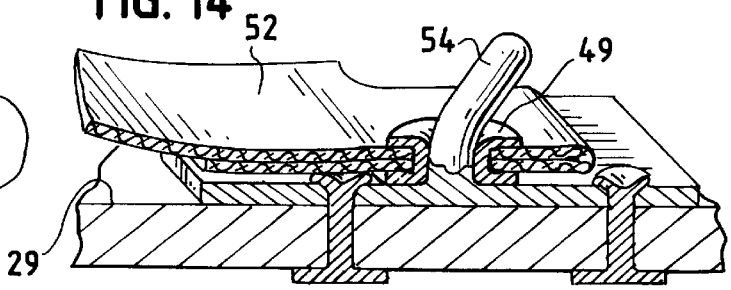
FIG. 14 is an enlarged cross-sectional view of the grommetted strap and the cleat of FIG. 13.

The flexible bag 22 is supported by, and secured to, each corner of the upper frame portion 28 by means of four grommetted straps 52 that are attached to the flexible bag 22 and releasably secured to associated cleats 54, each fixed to an associated corner brace member 55 that is part of the upper frame portion 28. The flexible bag 22 is also supported by the pallet-base portion 26, and is secured to the pallet-base portion 26 by means of four grommetted straps 52 that are attached to the flexible bag 22 and secured to cleats 54 on an outer region of the pallet-base portion 26. Each grommetted strap 52 includes a grommet 49 attached thereto (FIGS. 13 and 14) and each grommetted strap 52 is preferably attached to the flexible bag 22 by stitching the strap 52 to a reinforced area 60 on the flexible bag 22.

In the filled configuration, the flexible bag 22 provides tensioning support to the frame 24 and the frame 24 provides lateral support for the flexible bag 22. The flexible bag 22 is itself of sufficient strength to contain the liquid or the freely flowable solid material with which it is filled, but requires the pallet-base portion 26 and frame 24 to provide lateral stability for shipment.

Figure 4:
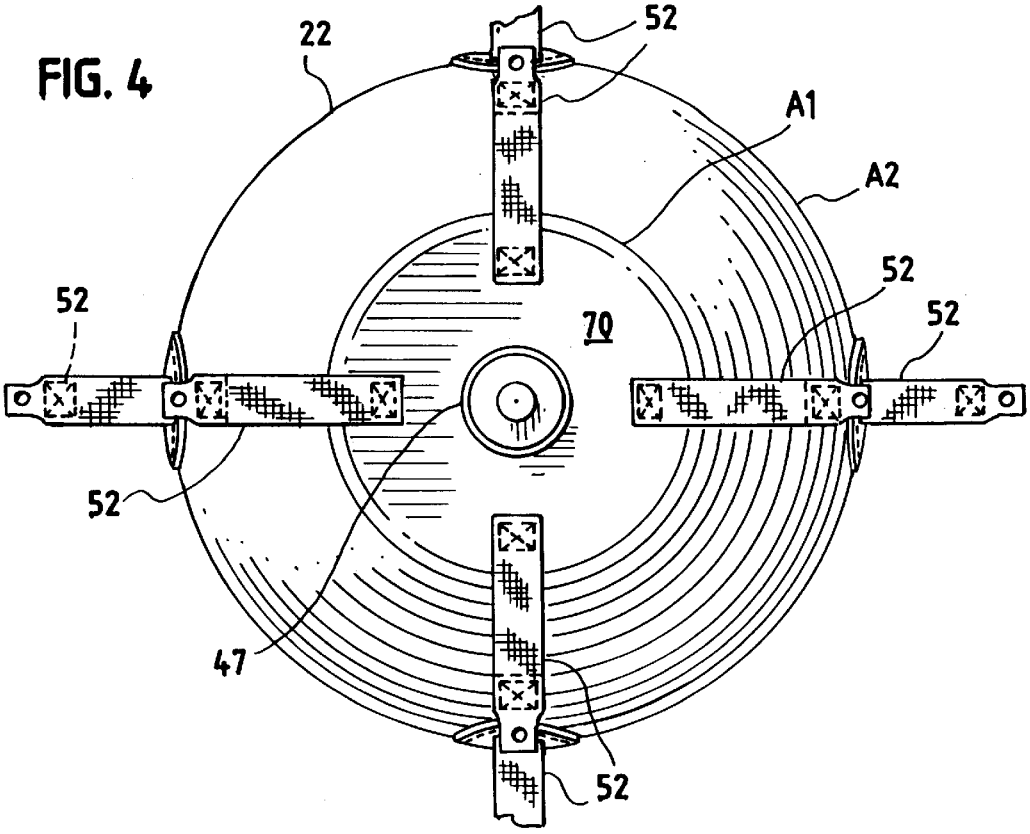
FIG. 4 is a plan view of a flexible bag portion of the container of FIG. 1.
Figure 5:
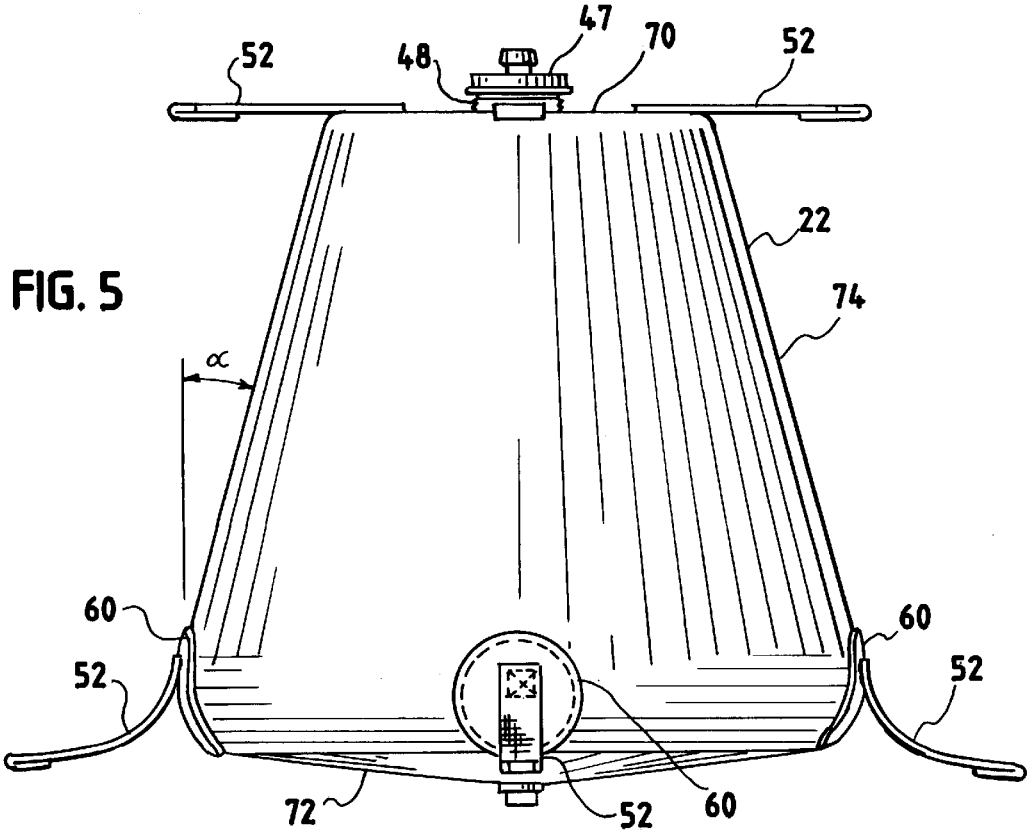
FIG. 5 is a side elevational view of the flexible bag of FIG. 4.
Figure 6:
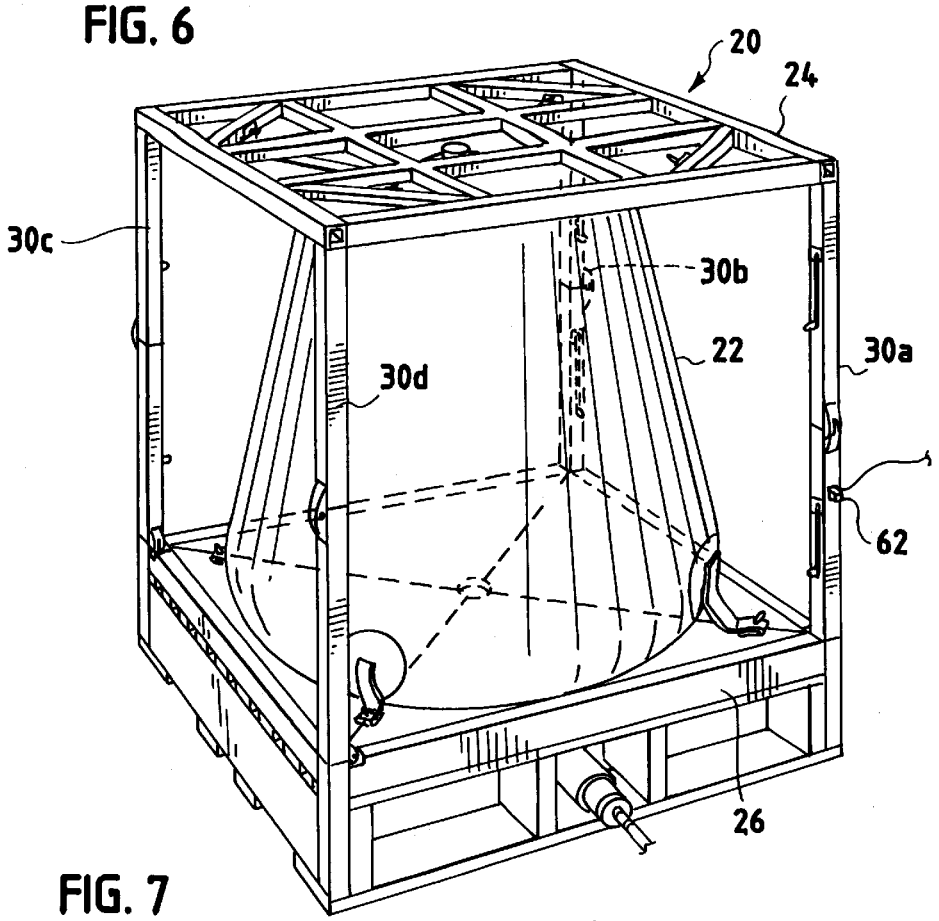
FIG. 6 is a perspective view of the container of FIG. 1, in a full configuration.
Figure 7:
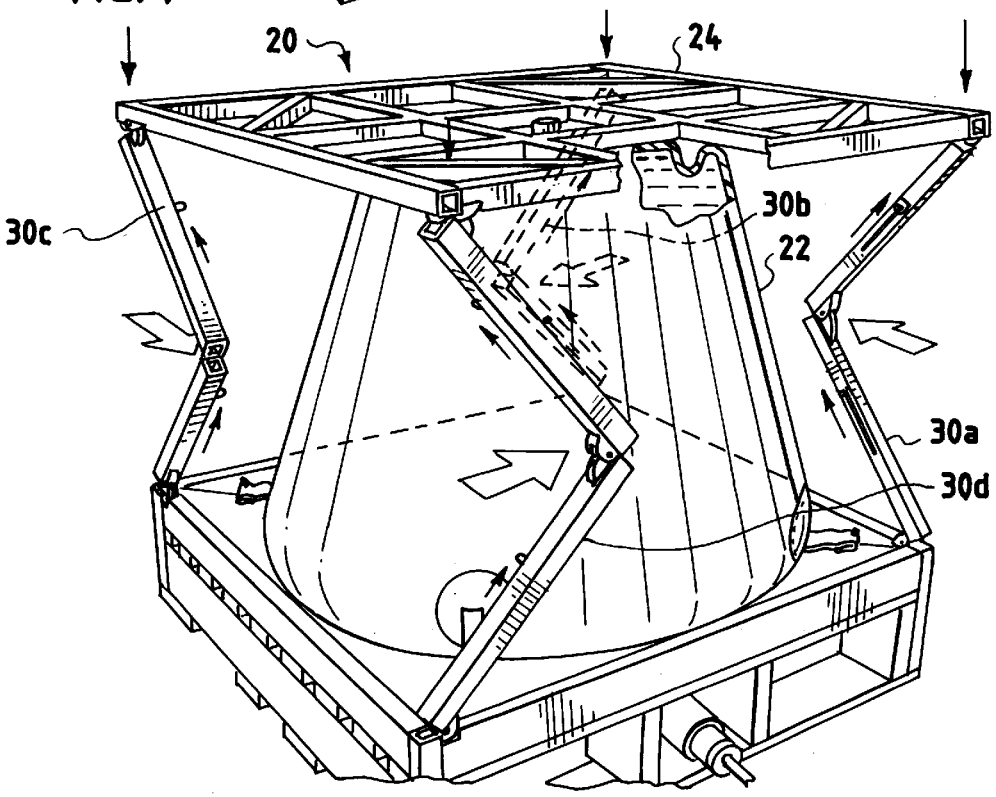
FIG. 7 is a perspective view of the container of FIG. 1, in a partially filled configuration (i.e. during emptying or filling)
Figure 8:
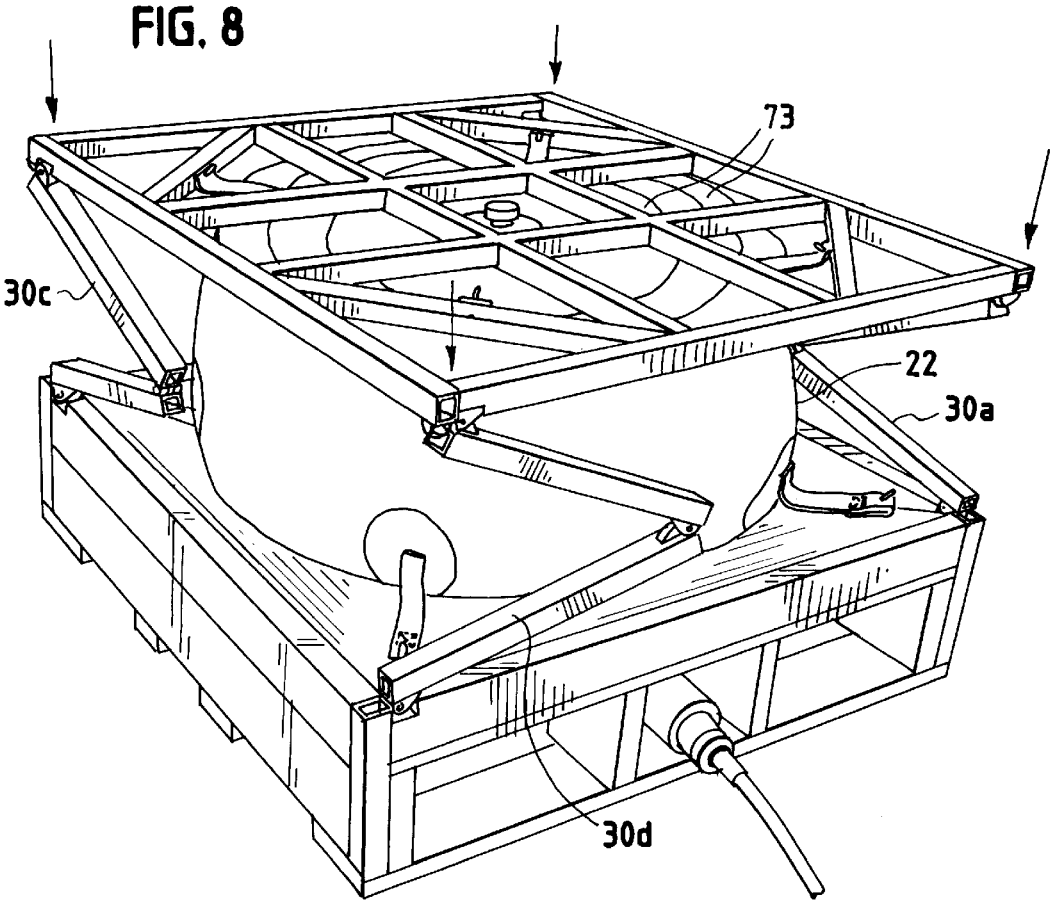
FIG. 8 is a perspective view of the container of FIG. 1, in an approximately half-full configuration.
Figure 9:
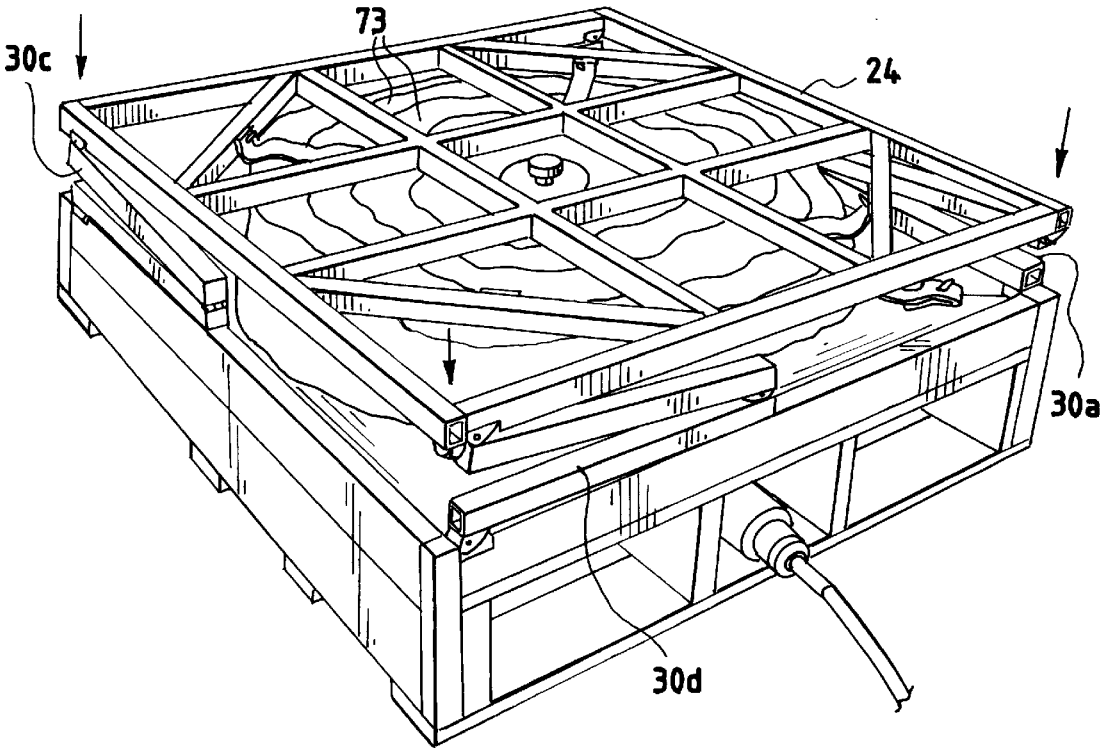
FIG. 9 is a perspective view of the container of FIG. 1, in a substantially empty configuration.
Figure 10:
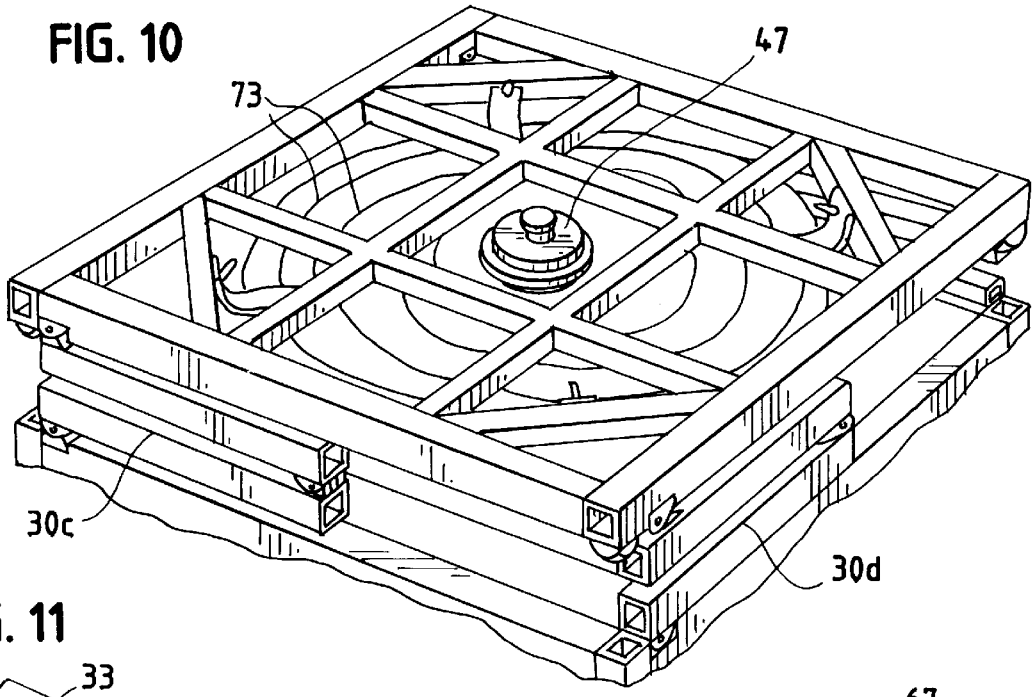
FIG. 10 is a perspective view of the container of FIG. 1, in a fully empty and collapsed configuration.

The flexible bag 22 has a particularly important combination of design features that allows the flexible bag 22 to collapse on itself when emptying. As best seen in FIGS. 2 and 5, the flexible bag 22 has a substantially flat upper portion 70 and a slightly sloped lower portion 72 (that follows the contour of the concave shape of the upper surface 29 of the pallet-base portion 26). As seen in FIG. 4, the lower portion 72 defines a first projected area, $A_1$, that is greater than a second projected area, $A_2$, defined by the upper portion 70. The flexible bag 22 has substantially straight sidewalls 74, joining the upper portion 70 to the lower portion 72, that are inclined at an angle, $\alpha$ (FIG. 5), of from about 2 degrees to about 20 degrees off the vertical, and preferably from about 5 degrees to about 15 degrees off the vertical, due to a slight decrease in the diameter of the flexible bag 22 as a function of distance above the pallet-base portion 26. This slightly decreasing diameter results in the flexible bag 22 having a substantially frustoconical, tapered shape that provides a number of important benefits.

First, the weight of the contents of the flexible bag 22 is always concentrated toward the bottom of the flexible bag 22 for increased stability. Second, any tendency of the flexible bag 22 to sag sideways is resisted by the shape of the flexible bag and by the weight of the greater volume of the contents of the flexible bag 22 below. Third, the weight of the upper portion 70 assists in the removal of the contents of the container 20 when the top fitment 48 is closed, by pushing down on the flexible bag 22. Fourth, the tapered shape of the flexible bag 22 (as best seen in FIG. 2) induces an a accordion-like manner of collapsing, wherein as the flexible bag 22 collapses, the upper portion of the sidewall collapses in an accordion-like shape to become part of a series of concentric vertical folds 73 (FIGS. 8–10) throughout the flexible bag 22. This accordion-like manner of collapsing ensures complete emptying of the flexible bag 22. Such concentric vertical folds also eliminate the possibility of interference with the frame 24 as the frame 24 collapses.

These latter benefits are of particular importance since, as the articulated frame members 30*a–d* begin to bend when the flexible bag 22 is full (with the top fitment 48 closed) and the flexible bag 22 is about to be emptied (i.e., when the midspan locking pins 38 and the lower locking pins 40 are in the unlocked position), the weight of the upper frame portion 28 rests on the top of the closed flexible bag 22 and assists gravitational air pressure in the removal of the contents of the flexible bag 22, as those contents are drained or pumped through the bottom fitment 50. This is of particular benefit if the flexible bag 22 contains a viscous fluid.

Because the flexible bag 22 collapses completely and expels essentially all of its contents, little or no cleaning may be required for reuse. The flexible bag 22 and the frame 24, when collapsed, may be refilled by pumping contents in through the bottom fitment 50. Filling the flexible bag 22 through the bottom fitment 50 causes the flexible bag 22 to inflate vertically, thereby lifting the upper frame portion 28 into place, it only being necessary to completely straighten and lock the articulated frame members 30*a–d* in place, using the locking pins 38, 40, for shipment. The flexible bag 22 may also be secured empty in the erected frame 24 or the flexible bag may be inflated with air and then filled with liquid or freely flowable solid material, by opening the top fitment 48 (to allow air to escape from the flexible bag 22), and filling the flexible bag 22 through the bottom fitment 50. The container 20 may also be stacked upon another container 20 when each container 20 is in the locked position, as seen in FIG. 3. The container 20 may also be stacked in the empty, collapsed position, thereby minimizing storage and/or shipping volumes.

Provided that the burst pressure of the flexible bag 22 is sufficiently high, the containers 20 could be filled after being stacked, by filling the bottom container 20 first and filling each container 20 above sequentially. This feature allows a shipper to fill the containers 20 after placing them in a vehicle, thereby allowing the shipper to be concerned only with manipulating (e.g., by hand or hand truck) the individual containers 20 when empty and relatively light.

Another desirable feature of the container 20 in accordance with the invention is that all components of the container 20 may be permanently attached to the pallet-base portion 26, with the exception of the flexible bag 22, which may be removed for complete or partial disposal. This feature eliminates the risk of losing components of the container 20, and is important because lost components can render containers useless or compromise safety and ease of handling.

The container 20 of the invention is very easily erected, emptied, collapsed, filled, or readied for return by one person. There is no requirement for lifting and fitting separated components. The container 20 may be filled through the top fitment 48 in either the collapsed or in the erected position, or through the bottom fitment 50 in either the collapsed or the erected position. It will self-erect as described above when filled through a closed fitment.

When the container 20 is to be emptied, the locking pins 38, 40 are first moved to the unlocked position. Next, the articulated frame members 30–*d* are laterally tapped, as indicated by the horizontal arrows in FIG. 7, to ensure that they will bend as the container 20 empties. The center discharge port 51 in the concave upper surface 29 of the pallet-base portion 26 ensures complete emptying of the flexible bag 22 and the slope of the discharge pipe 53 ensures complete drainage. Since the discharge valve 56 and quick-connect discharge fitting 57 are conventional, there are no special tools required for emptying the flexible bag 22.

Because the container gradually collapses as it is emptied, there is no need to "break down" the frame after emptying the container. The collapsing frame provides weight to assist in the removal of the contents of the container when the top fitment is closed, and the bag is flexible bag provides stability when the container is full and as the container is being emptied. The bag is induced to collapse flat.

The stability of the container 20 during shipment is ensured by the locking pins 38, 40 in each articulated frame member 30*a–d*, that prevent the hinges 34, 36 from bending. When the locking pins 38, 40 are in the locked position, the frame 24 is rigid and stabilizes the flexible bag 22 during any surges in shipment.

The container 20 in accordance with the invention has the advantage of the user being able to estimate how full the flexible bag 22 is by looking, from a distance, at the degree to which the container has collapsed, or, if the upper straps 52 are not attached to the frame 24, by looking at the degree to which the flexible bag 22 has collapsed. In addition, a mechanical, electronic (e.g. a hall effect device), or an electromechanical device, such as an electrical switch 62, mounted to one of the articulated frame members 30*a–d*, may be used to alert the user that the container 20 is nearly empty. For example, the electrical switch 62 can be configured to complete an electrical connection to a warning light or audible alarm when the articulated frame members 30–*d* are fully collapsed or at any predetermined position. The electrical switch 62 can be removably attached to one of the articulated frame members 30*a*–*d*, for example, by a VELCRO® or similar fastener or any other suitable means, so that the electrical switch 62 can be removed from the container 20 after the container 20 is empty and ready for return. Thus the electrical switch 62 can be quickly mounted to a replacement full collapsible container 20. Even when the articulated frame members 30–*d* are fully collapsed, some contents will be continuing to drain out of the flexible bag 22, due to the concave shape of the upper surface 29 of the pallet-base portion 26.

The electrical switch 62 may be supplemented or replaced by a vacuum switch on the suction side of a discharge pump (not shown), connected to the discharge fitting 57, that will alert the user and/or deactivate the pump when the flexible bag 22 is completely empty, due to the slight vacuum that will be present in the flexible bag 22, and in the discharge pipe 53 when the flexible bag 22 is empty.

FIGS. 15 and 16 show an alternative arrangement for locking each of the articulated frame members 30–*d* in a straight position. The alternative locking arrangement comprises a locking mechanism 68 that includes an external locking pin 71 that is slidably secured to the articulated arm by four lugs 75. When the locking mechanism 68 is in a locked position, as shown in FIG. 15, the external locking pin 71 is positioned such that it passes through all four lugs 75, two of which are secured to the portion of each articulated leg 30–*d* above the midspan hinge 32, and two of which are secured to the portion of each articulated leg 30–*d* below the midspan hinge 32. The external locking pin 71 is retained in the locked position by a lower spring clip 80 that is attached to the portion of each articulated leg 30–*d* above the midspan hinge 32. When the locking mechanism 68 is in an unlocked position, as shown in FIG. 16, the external locking pin 71 is positioned such that it passes through only the upper two lugs 75, which are secured to the portion of each articulated leg 30–*d* above the midspan hinge 32. The external locking pin 71 is retained in the unlocked position by an upper spring clip 82, that is attached to the portion of each articulated leg 30–*d* above the midspan hinge 32. Such an alternative locking arrangement can be used for locking each of the lower hinges 36, in which case the lower two lugs 75 could be replaced by a hole (not shown) in the pallet-base portion 26 to receive the external locking pin 71. The external locking pin 71 includes a transverse protrusion 73 that limits the movement of the external locking pin 71, and prevents removal of the external locking pin 71.

FIGS. 15 and 16, along with FIG. 17, also illustrate a protrusion 84 that can be secured to each corner of the upper frame 24, in the vicinity of each upper hinge 34, in order to guide and secure the portion of each articulated leg 30–*d* above the midspan hinge 32, as that portion rotates about the axis of the pin of the hinge 34 into the locked position. As seen in FIGS. 15 and 17, the protrusion 84 fits within the upper end of each articulated leg 30–*d* when the articulated leg 30–*d* is in the locked position, to stabilize the hinged joint.

The foregoing detailed description is given for clearness of understanding only, and no unnecessary limitations should be understood therefrom, as modifications within the scope of the invention may be apparent to those skilled in the art.

What is claimed is:

1. A collapsible bulk container, adapted to hold liquids or freely flowable solids, comprising:

a frame having a plurality of articulated members;

a flexible bag disposed within and secured to said frame; and, means for securing said flexible bag to said base portion and to said upper frame portion, said securing means comprising a plurality of straps attached to said flexible bag, a plurality of cleats attached to said base portion, and a plurality of cleats attached to said upper frame portion;

wherein said frame further comprises:

a base portion disposed below said flexible bag; and, an upper frame portion disposed above said flexible bag, and said frame is adapted to (a) gradually collapse as said flexible bag is emptied and (b) gradually extend as said flexible bag is filled.

2. The container of claim 1, wherein said articulated members extend between said base portion and said upper frame portion.

3. The container of claim 2, wherein each said articulated member is hingedly connected to said base portion and said upper frame portion.

4. The container of claim 3, wherein each said articulated member includes a hinged joint between said base portion and said upper frame portion.

5. The container of claim 1, wherein said flexible bag includes a lower portion and an upper portion, said lower portion defining a projected area greater than a projected area defined by said upper portion.

6. The container of claim 5, wherein said flexible bag has a substantially tapered vertical cross-sectional shape when filled.

7. The collapsible bulk container of claim 6, wherein said flexible bag comprises an integral, fabric-reinforced sealed layer.

8. The collapsible bulk container of claim 6, wherein said flexible bag comprises a fabric bag lined with at least one waterproof film.

9. The collapsible bulk container of claim 8, wherein said flexible bag further comprises at least one fitment adapted for filling and/or emptying the bag attached to the fabric bag but not to the waterproof film(s).

10. A bulk container, comprising:

a collapsible frame including a base portion, a plurality of articulated members disposed on the base portion and an upper frame portion disposed on the plurality of articulated members; and a flexible bag disposed in the frame, the flexible bag having a shape when separate from the frame and when filled including a top portion of a first cross-sectional size and a bottom portion of a second cross-sectional size larger than the first cross-sectional size;

wherein the bag assists in erecting the frame in a stable fashion when a flowable material is introduced into the flexible bag and wherein the bag assists in collaspsing the frame in a stable fashion when flowable material is emptied from the bag.

11. The bulk container of claim 10, wherein the frame further includes locking members movable to a locked position to lock the frame in a fully erect position after the frame has been erected by the bag.

12. The bulk container of claim 10, wherein each articulated member includes a hinged joint which pivots during erecting or collapsing of the frame.

13. The bulk container of claim 10, wherein the bag comprises an integral, fabric-reinforced sealed layer.

14. The bulk container of 13, wherein the bag further comprises at least one fitment adapted for filling and/or emptying the bag and attached to the integral, fabric-reinforced sealed layer.

15. The bulk container of claim 10, wherein the bag comprises a fabric bag lined with at least one waterproof film.

16. The bulk container of claim 15, wherein the bag further comprises at least one fitment adapted for filling and/or emptying the bag and attached to the at least one waterproof film.

17. The bulk container of claim 16, wherein the fitment is also attached to the fabric bag.

18. The bulk container of claim 10, further including means for securing the bag to the frame.

19. The bulk container of claim 18, wherein the securing means comprises a number of straps attached to the bag, a first plurality of cleats attached to the base portion and a second plurality of cleats attached to the upper frame portion.

* * * * *